US005466987A

United States Patent [19]

Williamson

[11] Patent Number: 5,466,987

[45] Date of Patent: Nov. 14, 1995

[54] RIGID MOUNTING FOR ARC DISCHARGE LAMP ARC TUBE

[75] Inventor: Glen P. Williamson, Manchester, N.H.

[73] Assignee: Osram Sylvania Inc., Danvers, Mass.

[21] Appl. No.: 812,672

[22] Filed: Dec. 23, 1991

[51] Int. Cl.[6] ..... H01J 61/34

[52] U.S. Cl. ..... 313/25; 313/639

[58] Field of Search ..... 313/25, 642, 565, 313/601, 242, 251, 252, 266, 284, 285, 289, 317, 639, 571, 290, 292, 331

[56] References Cited

U.S. PATENT DOCUMENTS

| | | | |
|---|---|---|---|
| 3,363,134 | 1/1968 | Johnson | 313/289 X |
| 3,407,327 | 10/1968 | Koury et al. | 313/639 |
| 5,173,632 | 12/1992 | Dolan et al. | 313/25 |
| 5,212,424 | 5/1993 | Russell et al. | 313/639 X |

FOREIGN PATENT DOCUMENTS

| | | | |
|---|---|---|---|
| 0236571 | 9/1989 | Japan | 313/25 |

*Primary Examiner*—Sandra L. O'Shea
*Assistant Examiner*—Ashok Patel
*Attorney, Agent, or Firm*—William H. McNeill

[57] ABSTRACT

A metal halide arc discharge lamp includes a metal halide arc tube located within a lamp envelope, a lamp stem having first and second stem leads extending therethrough, and a frame member mechanically connected between the first stem lead and a first end portion of the arc tube. A resistor can be connected between the second stem lead and a starting electrode lead for increased mechanical support. The resistor and the frame member provide the only mechanical support for the arc tube in the lamp envelope. The dome end of the arc tube is mechanically unsupported.

7 Claims, 4 Drawing Sheets

RIGID MOUNTING FOR ARC DISCHARGE LAMP ARC TUBE

FIELD OF THE INVENTION

This invention relates to arc discharge lamps and, more particularly, to metal halide arc discharge lamps wherein the arc tube is mechanically supported entirely from the base end of the lamp and is mechanically unsupported at the dome end of the lamp envelope.

BACKGROUND OF THE INVENTION

Metal halide arc discharge lamps are widely used for general illumination. These lamps include an arc tube mounted within a light-transmissive lamp envelope. The lamp envelope may be evacuated or backfilled with nitrogen. The arc tube has electrodes mounted at opposite ends and contains a fill material including a starting gas, mercury and one or more metal halides. A starting electrode is typically mounted at one end of the arc tube adjacent to one of the main electrodes to assist in starting.

The arc tube can be supported within the lamp envelope using a so-called "frameless" construction as disclosed in U.S. Pat. No. 3,407,327, issued Oct. 22, 1968 to Koury et al. In the frameless construction, a strap encircles the press seal at each end of the arc tube. A lower frame member is attached between the strap at the base end of the arc tube and one of the stem leads that passes through the lamp stem. An upper frame member is attached to the strap at the dome end of the arc tube. Bulb spacers attached to the upper frame member retain the upper end of the arc tube in a fixed position relative to the lamp envelope.

The arc tube must be supported within the lamp envelope in a manner to withstand the shock to which the lamp may be subjected during shipping and handling. If the arc tube moves within the lamp envelope as a result of a shock, the arc tube may be damaged, the light output may be reduced, or electrical conductors within the lamp may be short circuited. Accordingly, metal halide arc discharge lamps are normally required to withstand shocks incurred during shipping and handling without damage. However, the shock resistant design should be easy to manufacture and should have a relatively low cost. In addition, the lamp design should be compatible with high speed, automated sealing equipment.

It is a general object of the present invention to provide improved arc discharge lamps.

It is another object of the present invention to provide metal halide arc discharge lamps wherein the arc tube is mechanically supported only from the base end of the lamp.

It is a further object of the present invention to provide metal halide arc discharge lamps wherein an upper frame member is not required.

It is still another object of the present invention to provide metal halide arc discharge lamps which are resistant to shock.

It is yet another object of the present invention to provide metal halide arc discharge lamps which are easy to manufacture and which are low in cost.

SUMMARY OF THE INVENTION

According to the present invention, these and other objects and advantages are achieved in an arc discharge lamp comprising a light-transmissive lamp envelope, an arc tube located within the lamp envelope for generating light when electrical energy is applied thereto, a lamp stem sealed to the lamp envelope and having first and second stem leads extending therethrough, a frame member mechanically connected between the first stem lead and a base end portion of the arc tube, and means for electrically connecting the first and second stem leads to first and second main electrodes of the arc tube, respectively. A dome end of the arc tube adjacent to the dome end of the lamp envelope is mechanically unsupported.

The arc discharge lamp preferably further includes a resistor connected between the second stem lead and a starting electrode lead of the arc tube. The resistor provides additional mechanical support for the arc tube. Preferably, the resistor has nickel leads for stiffness and for thermal compatibility with the electrode lead and the stem lead.

The arc tube is preferably a metal halide arc tube containing a starting gas, mercury and one or more metal halides.

In a preferred embodiment the first and second stem leads comprise nickel or stainless steel, and each stem lead has a diameter of at least 0.060 inch. The frame member is preferably welded to the first stem lead and is welded to a strap that encircles the arc tube near its base end.

BRIEF DESCRIPTION OF THE DRAWINGS

For a better understanding of the present invention, together with other and further objects, advantages and capabilities thereof, reference is made to the accompanying drawings which are incorporated herein by reference and in which.

DESCRIPTION OF THE PRIOR ART

Figure 1A:
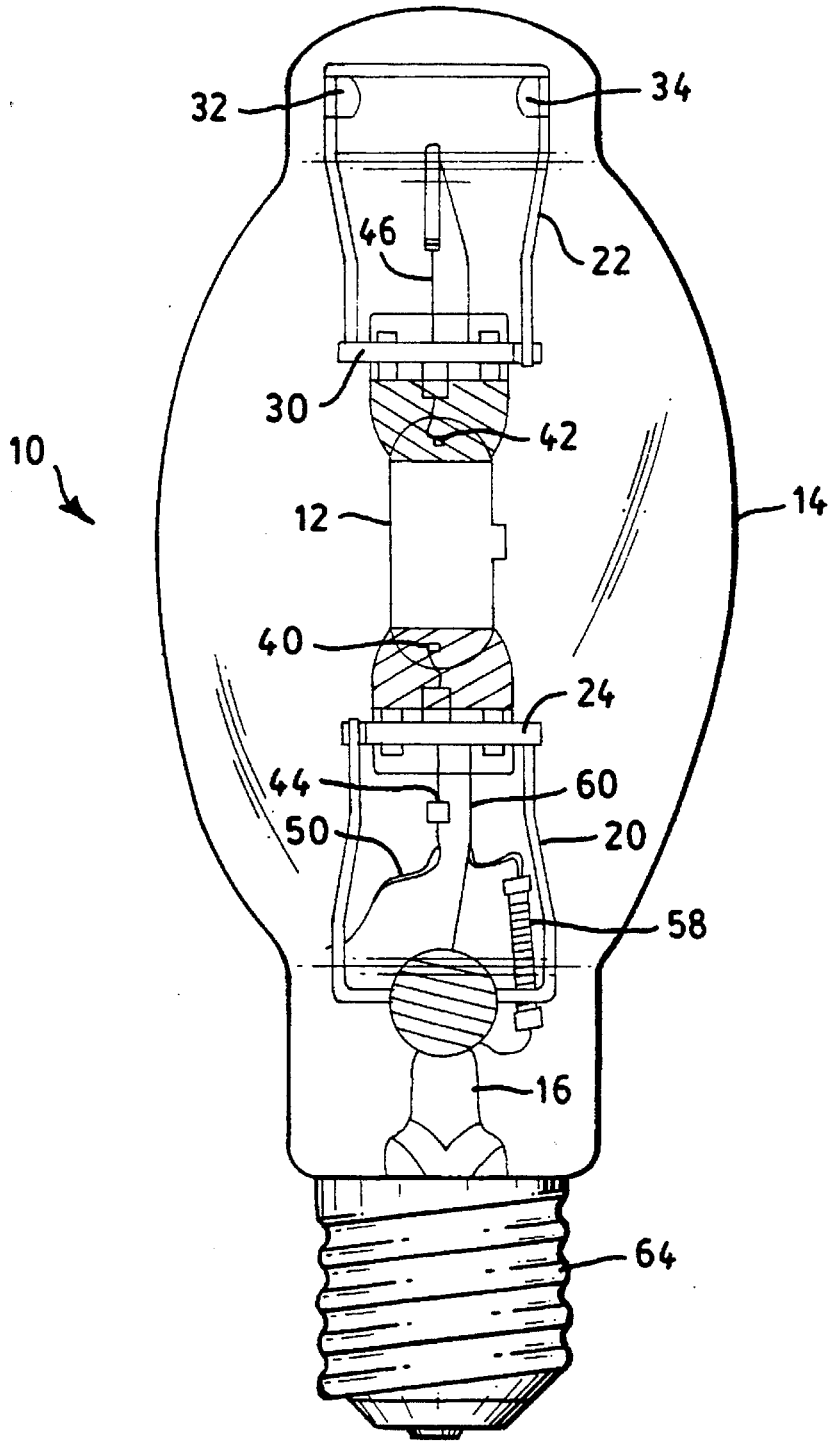
FIG. 1A PRIOR ART
FIG. 1A is a front elevation view of a metal halide arc discharge lamp in accordance with the prior art.
Figure 1B:
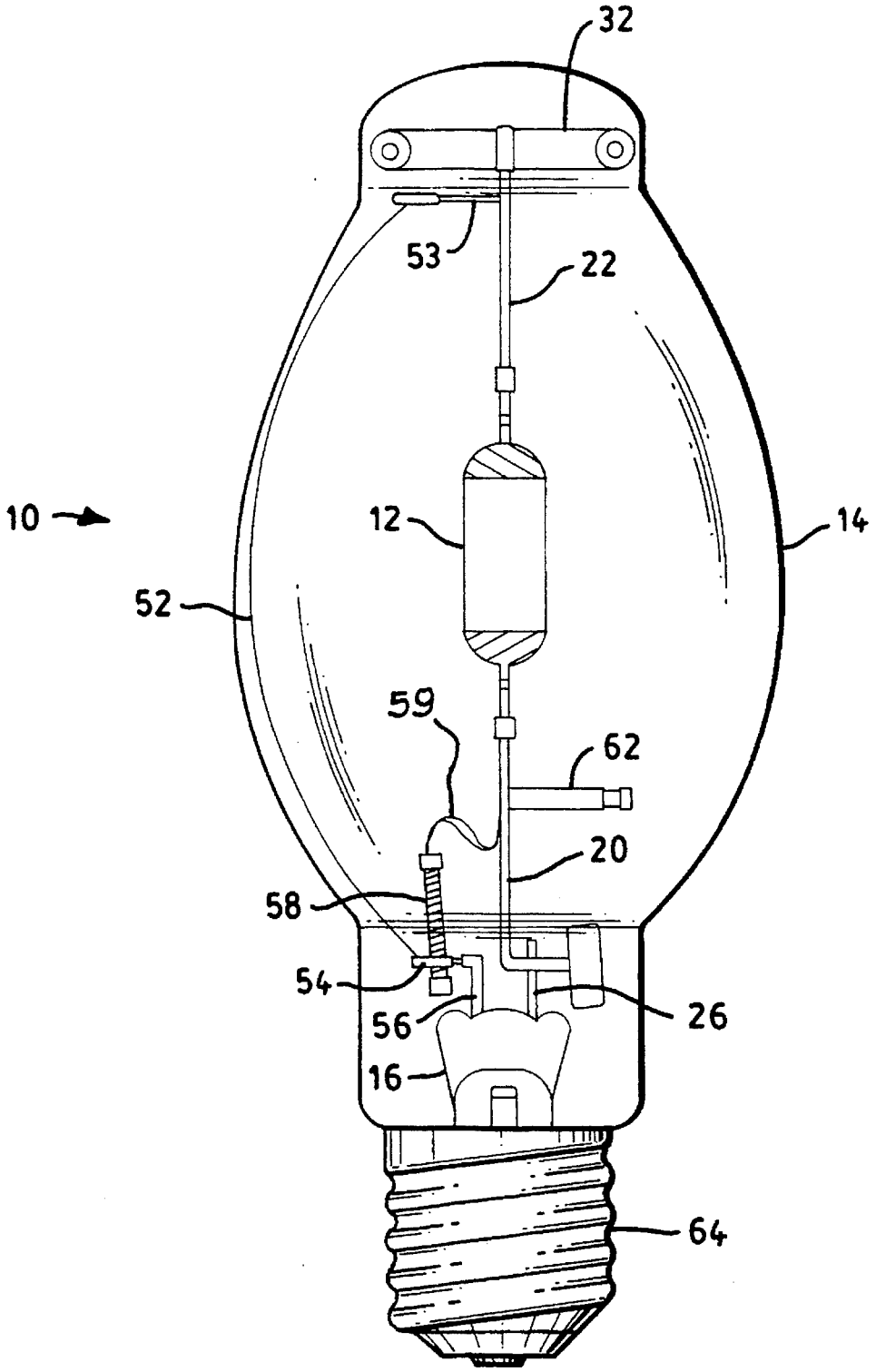
FIG. 1B PRIOR ART
FIG. 1B is a side elevation view of the metal halide arc discharge lamp of FIG. 1A.

A metal halide arc discharge lamp 10 utilizing a so-called "frameless" structure is shown in FIGS. 1A and 1B. The lamp 10 includes an arc tube 12, typically quartz, mounted within a light-transmissive lamp envelope 14. The lamp envelope 14 is hermetically sealed to a lamp stem 16. The lamp envelope 14 is filled with an inert gas. The preferred gas is nitrogen at a pressure of approximately 400 torr. However, the pressure can be within a range from 100 torr to approximately one atmosphere, depending on the lamp type.

The arc tube 12 is mechanically supported within lamp envelope 14 by a lower frame member 20 and an upper frame member 22. Lower frame member 20 is welded to a strap 24 that encircles a lower press seal near a base end of arc tube 12. The lower frame member 20 is welded to a stem lead 26 that is sealed into lamp stem 16. Upper frame member 22 is welded to a strap 30 that encircles an upper press seal near a dome end of arc tube 12. Bulb spacers 32 and 34 attached to upper frame member 22 contact an inside surface of lamp envelope 14 in the dome end thereof and maintain the dome end of arc tube 12 in a fixed position relative to lamp envelope 14.

Figure 2A:
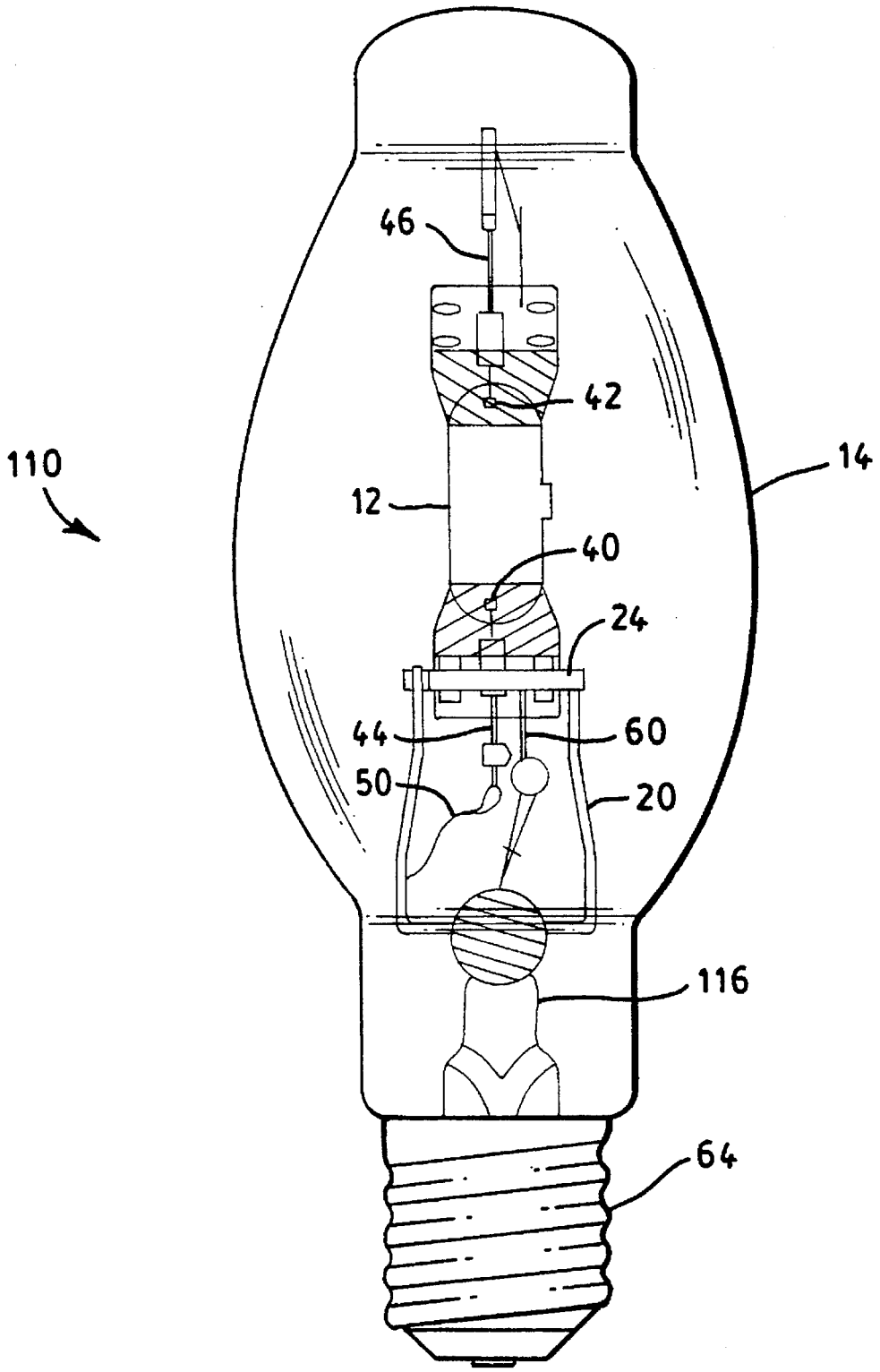
FIG. 2A is a front elevation view of a metal halide arc discharge lamp in accordance with the present invention.
Figure 2B:
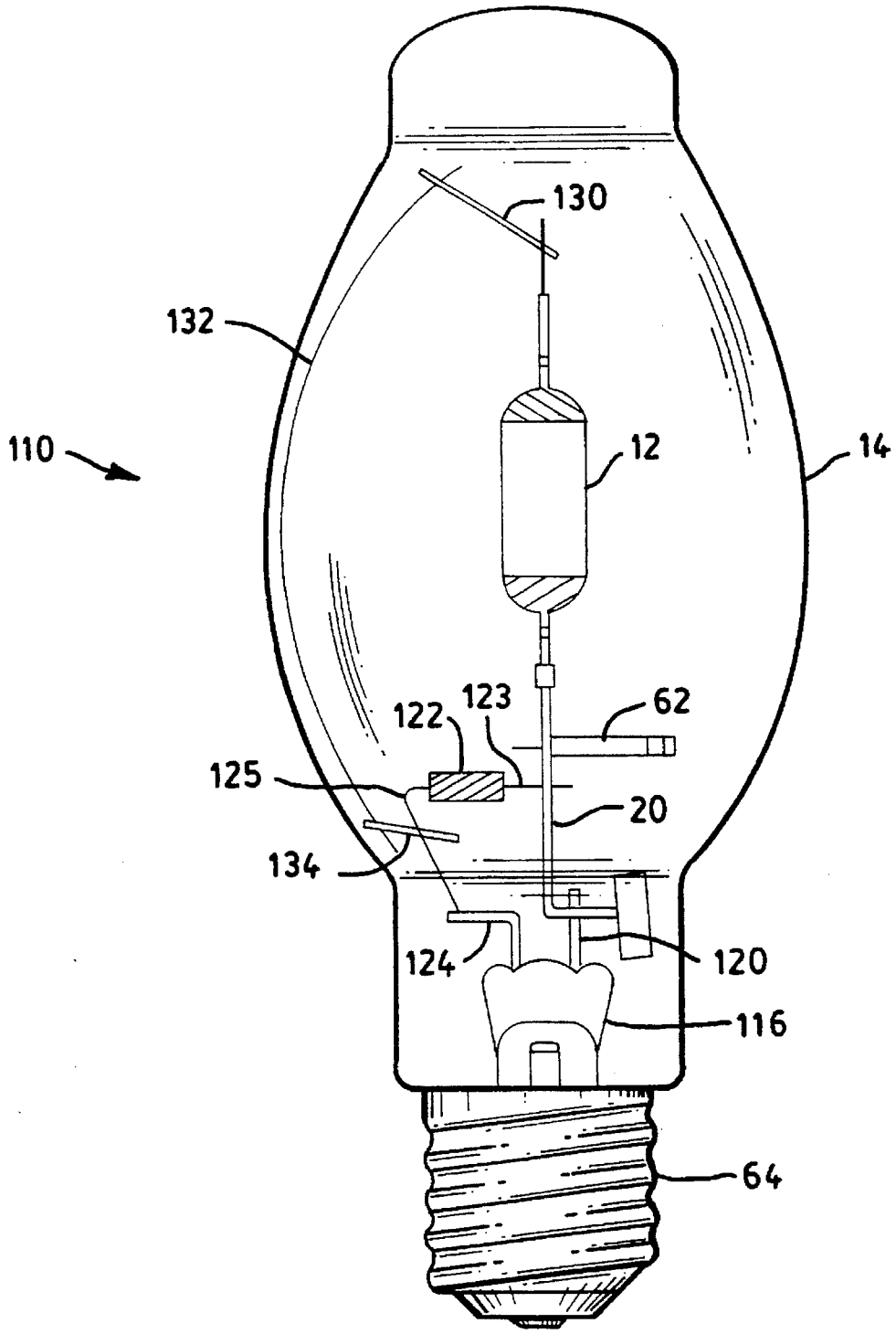
FIG. 2B is a side elevation view of the metal halide arc discharge lamp of FIG. 2A.

The arc tube 12 includes main electrodes 40 and 42 mounted in opposite ends thereof. Electrode 40 is electrically connected to an external lead 44, and electrode 42 is electrically connected to an external lead 46. Electrode lead 44 is connected by a nickel ribbon 50 to lower frame member 20. Electrode lead 46 is connected by a conductor 52 and nickel strips 53 and 54 to a stem lead 56. A resistor 58 is connected to stem lead 56 and is connected via a nickel ribbon 59 to a starting electrode lead 60. A bimetal switch 62 is mounted between electrode lead 44 and starting electrode lead 60. The bimetal switch 62 controls application of a voltage between main electrode 40 and a starting electrode, as known in the art. The stem leads 26 and 56 extend through lamp stem 16 to a lamp base 64. The arc tube 12 contains a fill material such as argon gas, mercury and one or more metal halides. Detailed Description of the Invention A metal halide arc discharge lamp 110 in accordance with the present invention is shown in FIGS. 2A and 2B. Like elements in FIGS. 1A, 1B, 2A and 2B have the same reference numerals. The lamp 110 includes arc tube 12 mounted within light-transmissive lamp envelope 14. The lamp envelope is hermetically sealed to a lamp stem 116. The lamp envelope 14 is filled with an inert gas as described above.

The arc tube 12 is mechanically supported by lower frame member 20. The frame member 20 is welded to strap 24 which encircles the press seal at the base end of the arc tube 12. The lower frame member 20 is welded to a stem lead 120. A resistor 122 has one lead 123 welded to starting electrode lead 60 and the other lead 125 welded to a stem lead 124. The lower frame member 20 and the resistor 122 provide the only mechanical support for the arc tube 12 within lamp envelope 14. The upper or dome end of arc tube 12 is mechanically unsupported.

External lead 44 at the base end of arc tube 12 is electrically connected to frame member 20 by nickel ribbon 50. A nickel strip 130 is welded to external lead 46. A nickel strip 134 is welded to lead 125 of resistor 122. A conductor 132 is electrically connected between nickel strips 130 and 134 to provide an electrical connection between stem lead 124 and electrode 42. The conductor 132 runs near the inside surface of lamp envelope 14 and is spaced from arc tube 12.

The lamp stem 116 in lamp 110 differs from the lamp stem 16 in lamp 10 according to the prior art in that the lamp stem 116 uses stiffer, more rigid stem leads 120 and 124. Preferably the stem leads 120 and 124 are nickel or stainless steel, each having a diameter of about 0.070 inch. It is preferred that the stem leads 120 and 124 have a diameter of at least 0.060 inch to provide sufficient mechanical support for arc tube 12 and lower frame member 20. By contrast, prior art stem leads had a diameter of about 0.050 inch.

The resistor 122 preferably has nickel leads for stiffness and for thermal compatibility with the molybdenum lead 44 and stem lead 124. In a preferred embodiment, the nickel leads of resistor 122 have diameters of at least 0.030 inch and preferably about 0.032 inch. By contrast, the resistor 58 used in prior art lamps had copper clad leads, with nickel ribbon 59 connected between resistor 58 and molybdenum lead 44.

Initially, a free-standing lamp design similar to that shown in FIGS. 2A and 2B without mechanical support of the dome end of the arc tube was tested with the prior art lamp stem and stem leads. The strength of the prior art stem leads was not sufficient to withstand a reasonable shock. Therefore, the arc tube assembly collapsed within the lamp envelope. Many attempts were made to weld the lower frame member to the stem lead using a two-point weld truss design. In all cases, the stem lead failed when subjected to shock. The present invention, which relies upon lamp stem 116 with stiffer stem leads 120 and 124 and resistor 122 with nickel leads for support of arc tube 12, provides adequate support of the arc tube assembly when the lamp is subjected to shock.

The metal halide lamp design shown in FIGS. 2A and 2B and described above permits the elimination of six parts in comparison with the prior art lamp design. The strap 30 (made in two parts), upper frame member 32, bulb spacers 32 and 34 and nickel ribbon 58, all shown in FIGS. 1A and 1B, are eliminated in the metal halide lamp of the present invention, thereby reducing the parts cost of the lamp. In addition, the labor required to construct the arc tube assembly of the present invention is approximately 23% less than the labor cost of the prior art arc tube assembly shown in FIGS. 1A and 1B, based on parts removal and elimination of overall length requirements.

Furthermore, newer high speed automated equipment for sealing the lamp envelope to the lamp stem requires the free-standing arc tube assembly of the present invention, in which the arc tube assembly can be installed in the lamp envelope without friction. The prior art lamp shown in FIGS. 1A and 1B cannot be assembled in the newer sealing equipment because the bulb spacers produce friction with the lamp envelope.

The lamp design shown in FIGS. 2A and 2B and described above is particularly suited for 175 watt and 250 watt metal halide lamps, including both vertically and horizontally mounted lamps. However, the present invention is not limited to lamps of this wattage.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

an light-transmissive lamp envelop;

a arc tube located within the lamp envelope for generating light when electrical energy is applied thereto, said arc tube including an arc generating and sustaining medium therein and having first and second main electrodes oppositely mounted therein and an auxiliary electrode positioned adjacent said first electrode;

a lamp stem sealed to the lamp envelope and having first and second substantially rigid stem leads extending therethrough;

a frame member mechanically connecting said first stem lead and a first end of said arc tube for providing a first means of support for said arc tube;

means for electrically connecting said first stem lead to said first main electrode;

means for connecting said second stem lead to said second main electrode; and a second arc tube supporting means including a resistor having substantially rigid leads connected between said auxiliary electrode and said second stem lead.

2. An arc discharge lamp as defined in claim 1 wherein said first and second stem leads are selected from the group of nickel and stainless steel.

3. An arc discharge lamp as defined in claim 2 wherein said first and second stem leads each have a diameter of at least 0.060 inch.

4. An arc discharge lamp as defined in claim 3 wherein said frame member is welded to said first stem lead and is welded to a strap that encircles said first end of said arc tube.

5. An arc discharge lamp as defined in claim 1 wherein said resistor has nickel leads.

6. An arc discharge lamp as defined in claim 5 wherein the nickel leads of said resistor have diameters of at least 0.030 inch.

7. A metal halide arc discharge lamp comprising:

a light-transmissive lamp envelop;

an arc tube located within the lamp envelope for generating light when electrical energy is applied thereto, said arc tube including an arc generating and sustaining medium including at least one operable metal halide and having first and second main electrodes oppositely mounted therein and an auxiliary electrode positioned adjacent said first electrode;

a lamp stem sealed to the lamp envelope and having first and second substantially rigid stem leads extending therethrough;

a frame member mechanically connected between said first stem lead and a first end of said arc tube for providing a first means of support for said arc tube;

means for electrically connecting said first stem lead to said first main electrode;

means for electrically connecting said second stem lead to said second main electrode; and a second arc tube supporting means including a resistor having substantially rigid leads connected between said auxiliary electrode and said second stem lead.

* * * * *